US010073392B2

(12) United States Patent
Sakimura et al.

(10) Patent No.: US 10,073,392 B2
(45) Date of Patent: Sep. 11, 2018

(54) FIXING MEMBER, IMAGE FORMING APPARATUS, FIXING METHOD, AND IMAGE FORMING METHOD

(71) Applicant: Konica Minolta, Inc., Tokyo (JP)

(72) Inventors: Tomoo Sakimura, Hino (JP); Shingo Fujimoto, Hussa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/879,620

(22) Filed: Jan. 25, 2018

(65) Prior Publication Data

US 2018/0217533 A1 Aug. 2, 2018

(30) Foreign Application Priority Data

Feb. 1, 2017 (JP) ..... 2017-016700

(51) Int. Cl.
*G03G 15/20* (2006.01)

(52) U.S. Cl.
CPC ..... *G03G 15/206* (2013.01)

(58) Field of Classification Search
CPC ..... G03G 15/2053; G03G 15/2057; G03G 15/206
USPC ..... 399/333
See application file for complete search history.

(56) References Cited

U.S. PATENT DOCUMENTS 8,509,669 B2 * 8/2013 Moorlag et al. ... G03G 15/2057 399/333
8,929,792 B2 * 1/2015 Qi et al. ..... G03G 15/2057 399/333

FOREIGN PATENT DOCUMENTS

JP H07-191567 A 7/1995
JP 2007316529 A 12/2007

* cited by examiner

*Primary Examiner* — William J Royer
(74) *Attorney, Agent, or Firm* — Lucas & Mercanti, LLP

(57) ABSTRACT

A fixing member includes a base material, an elastic layer, and a surface layer, all of which are laminated in the order in a thickness direction, wherein the surface layer has a porous structure formed by a plurality of pores, each of which has a pore size of less than 1 μm.

9 Claims, 3 Drawing Sheets

FIXING MEMBER, IMAGE FORMING APPARATUS, FIXING METHOD, AND IMAGE FORMING METHOD

The entire disclosure of Japanese patent Application No. 2017-016700, filed on Feb. 1, 2017, is incorporated herein by reference in its entirety.

BACKGROUND

Technological Field

The present invention relates to a fixing member, an image forming apparatus including the fixing member, and a fixing method and an image forming method using the fixing member.

Description of the Related art

In an electrophotographic image forming apparatus, a fixing device bonds a heated fixing member and a recording medium (a medium) on which toner is placed by applying pressure so as to fix the toner on the medium. For example, in order to enhance endurance as well as adhesion between the fixing member and the medium, the following technique is known. That is, an elastic silicone rubber is disposed on a cored bar, and a porous fluororesin having porosity to volume of 20% or more is wound around the rubber, thereby forming a thermal pressure roller serving as the fixing member (for example, see JP 7-191567A).

In such an image forming apparatus, after the pressure bonding, it is required to separate the fixing member and the medium on which the toner has been fixed. In order to secure separability between the fixing member and the medium, a fluororesin layer such as tetrafluoroethylene/perfluoroalkyl vinyl ether copolymer (PFA) is currently widely used as a surface layer of the fixing member. Furthermore, the fixing device is additionally provided with a separation claw, and a separation-aid device such as a device to suction the medium and a device to blow air toward an edge portion of the medium. A known technique for enhancing the separability is such that a cell with a geometric pattern is formed on a base material so as to form a recessed cell on a surface of a fixing belt, thereby enhancing the separability (for example, see JP 2007-316529 A).

The aforementioned thermal pressure roller includes a surface layer that has a porous structure, but a relationship between the porous structure and the aforementioned separability is not mentioned in Patent Literature JP 7-191567 A, and is not known. Furthermore, the aforementioned fixing belt including the surface formed with the recessed cell brings about an effect to enhance the separability, but the effect depends on a shape of the surface of the fixing belt. Therefore, in the fixing belt having such a cell, abrasion of the surface layer with the use of the fixing belt eliminates the effect to enhance the separability.

Insufficiency of the separability may cause various problems in an electrophotographic image forming method. For example, insufficiency of the separability is likely to cause a medium to twine around a fixing member. Therefore, in the image forming method, media without stiffness (for example, with low rigidity) such as tissue paper may not be used. Furthermore, in the image forming method, speed of output (image formation) is increasing. The speed-up of output generally brings about a decline in the separability.

Accordingly, in the image forming method, insufficiency of the separability tends to be more prominent with respect to the media without stiffness.

As described above, the fixing member used in the electrophotographic image forming method leaves room for study from a viewpoint of enhancing the separability between the fixing member and the medium immediately after fixing.

SUMMARY

An object of the present invention is to provide a technique to emerge high separability over a long period even with respect to media without stiffness such as tissue paper when fixing a toner image in electrophotographic image formation.

To achieve the abovementioned object, according to an aspect of the present invention, a fixing member reflecting one aspect of the present invention comprises a base material, an elastic layer, and a surface layer, all of which are laminated in the order in a thickness direction, wherein the surface layer has a porous structure formed by a plurality of pores, each of which has a pore size of less than 1 μm.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
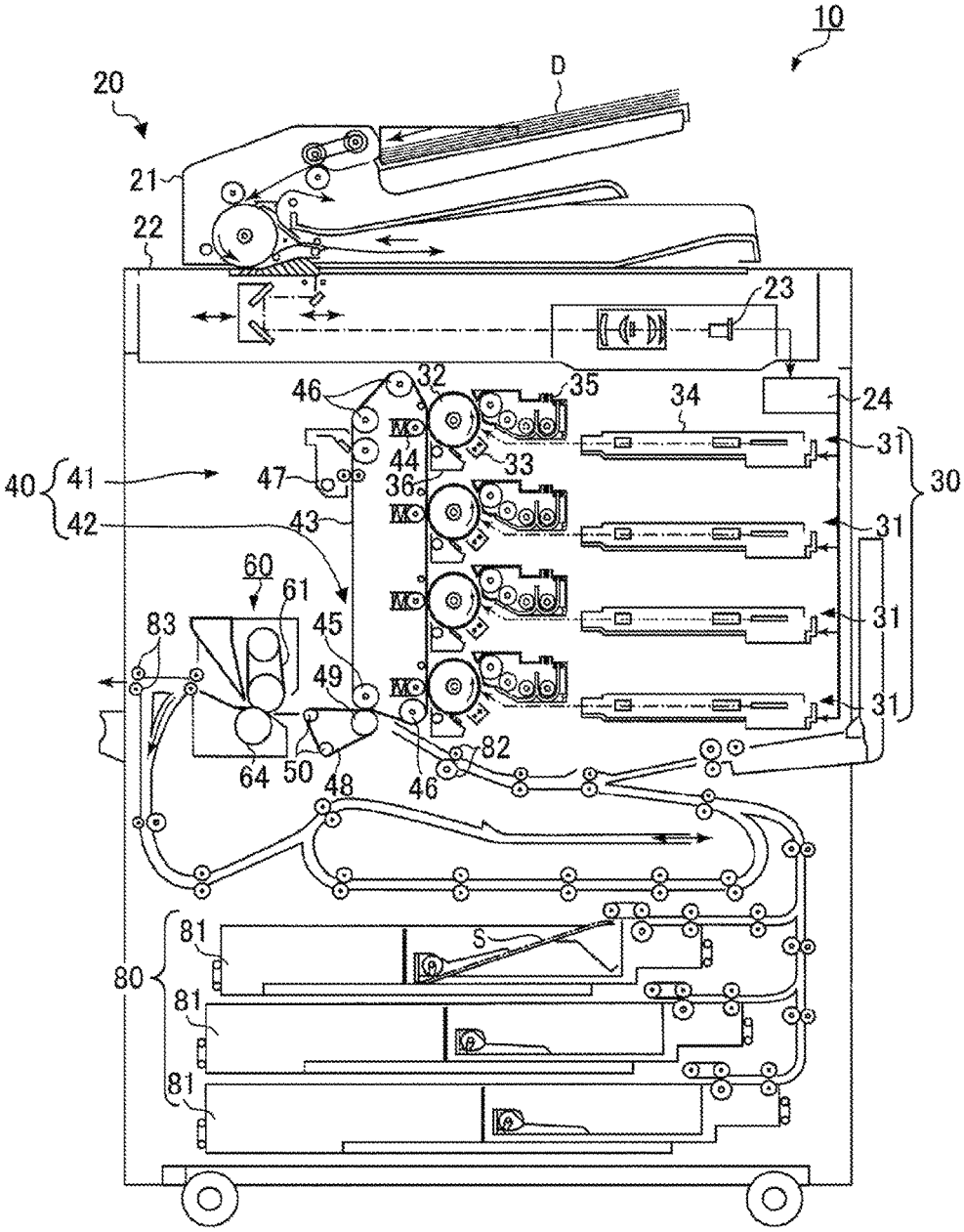
FIG. 1 is a schematic view illustrating a configuration of an image forming apparatus according to an embodiment of the present invention.

Hereinafter, one or more embodiments of the present invention will be described with reference to the drawings. However, the scope of the invention is not limited to the disclosed embodiments. A fixing method and an image forming method according to an embodiment of the present invention can be carried out in a manner similar to a known method, and an image forming apparatus according to an embodiment of the present invention can be configured as similar to a known apparatus, except that a fixing member according to an embodiment of the present invention is used.

The fixing member according to an embodiment of the present invention includes a base layer, an elastic layer, and a surface layer. The base layer, elastic layer, and surface layer are laminated in the order mentioned. The fixing member can be configured in a manner similar to a known fixing member, in which a base layer, an elastic layer, and a surface layer are laminated in the order mentioned, except that a surface layer to be described later is used herein. The fixing member may be a fixing sleeve in which the above three layers are carried on an outer periphery of a metal cylinder. Alternatively, the fixing member may be an endless fixing belt including the above three layers.

The base layer includes, for example, resin with heat resistance (heat resistant resin). The term "heat resistance" indicates sufficient stability at a temperature (for example, 150 to 220° C.) at which the fixing member is used to fix a toner image on a recording medium in electrophotographic image formation, and indicates emergence of desired physical properties.

The heat resistant resin is appropriately selected from resin which does not substantially denature or deform at the above operating temperature of the fixing member, and may be of one kind or more. Examples of the heat resistant resin include polyphenylene sulfide, polyarylate, polysulfone, polyether sulfone, polyether imide, polyimide, polyamide imide, and polyether ether ketone. Among these examples, polyimide is preferable from a viewpoint of heat resistance.

Polyimide can be obtained, for example, with acceleration of dehydration and cyclization (imidization) reactions of a polyamic acid, a precursor of polyimide, by heating the precursor at 200° C. or more or by a catalyst. The polyamic acid herein may be produced by a polycondensation reaction in which tetracarboxylic acid dianhydride and a diamine compound are dissolved in a solvent, being mixed and heated. Alternatively, a commercially available product may be used as the polyamic acid. Examples of the diamine compound and the tetracarboxylic acid dianhydride include the compounds recited in paragraphs 0123 to 0130 of JP 2013-25120 A.

The above heat resistant resin is a main material included in the base layer, and a content thereof may be an amount sufficient for forming the base layer. For example, the content of the heat resistant resin in the base layer is preferably 40 to 100 volume percent from a viewpoint of formability when preparing the base layer.

The base layer may further contain a component other than the heat resistant resin within a range where effects of this embodiment can be achieved. For example, the base layer may further contain a filler. The filler is, for example, a component that contributes to improvement in at least one of hardness, heat conductivity, and conductivity of the base layer. The filler may be of one kind or more, examples of which include carbon black, Ketjenblack, nanocarbon, and graphite.

An excessively large content of the filler in the base layer deteriorates toughness of the base layer, which may deteriorate fixability and separability of the fixing member. Furthermore, an excessively small content of the filler may bring about insufficiency of desired effects due to the filler such as moderate conductivity. From such a viewpoint, the content of the filler in the base layer is preferably 3% by mass or more, more preferably 4% by mass or more, still more preferably 5% by mass or more. Furthermore, from the above viewpoint, the content of the filler in the base layer is preferably 30% by mass or less, more preferably 20% by mass or less, and still more preferably 10% by mass or less.

The elastic layer includes, for example, an elastic material, and is a layer having elasticity that contributes to an improvement in a contact property, in a fixing nip portion, between a surface of the fixing member and the recording medium that carries an unfixed toner image. Examples of the elastic material include elastic resin materials, examples of which include silicone rubber, thermoplastic elastomers, and rubber materials. Among these examples, the elastic material is preferably silicone rubber from a viewpoint of heat resistance as well as desired elasticity.

The silicone rubber may be of one kind or more. Examples of the silicone rubber include polyorganosiloxane or a thermally-cured material thereof, and an addition reaction type silicone rubber recited in JP 2009-122317 A. An example of the polyorganosiloxane includes dimethylpolysiloxane having terminal ends both blocked by a trimethylsiloxane group and having a side-chain vinyl group, as recited in JP 2008-255283 A.

The elastic layer is preferably 5 to 300 μm in thickness, more preferably 50 to 250 μm from a viewpoint of, for example, sufficient emergence of the heat conductivity and elasticity.

The elastic layer may further contain a component other than the above elastic resin material within a range where the effects of this embodiment can be achieved. For example, the elastic material may further include a heat-conductive filler to enhance the heat conductivity of the elastic layer. Examples of a material of the filler include silica, metallic silica, alumina, zinc, aluminum nitride, boron nitride, silicon nitride, silicon carbide, carbon, and graphite. The filler is not limited in configuration, and may be in a state of, for example, spherical powder, amorphous powder, flat powder, and a fiber.

A content of the elastic resin material in the elastic material is, for example, preferably 60 to 100 volume percent, more preferably 75 to 100 volume percent, still more preferably 80 to 100 volume percent, from a viewpoint of achieving both the heat conductivity and elasticity.

The surface layer has a porous structure formed by a plurality of pores. The pores may be individually independent, or may be continuous in whole or in part. Higher porosity of the surface layer enhances the separability between the fixing member and the recording medium more favorably at the time of fixing, but excessively high porosity may cause insufficiency in strength of the fixing member. From such a viewpoint, the porosity of the surface layer is preferably 10 to 90%, and more preferably 20 to 80%.

When toner particles are fitted in the pores exposed on a surface of the surface layer, attachment force of the recording medium with respect to the fixing member may increase at the time of fixing, which may contaminate the fixing member. Therefore, in order to prevent unfixed toner particles on the recording medium from fitting into the pores at the time of fixing, a pore size of the pores is desirably half or less of a mean particle size of the toner particles used at the time of fixing (at the time of electrophotographic image formation). For example, the pore size of the pores may be less than 1 μm. The pore size may be a value representing the size of the pores, and may be, for example, a mean value or a maximum value.

Although there is no theoretical lower limit in the pore size, a lower limit value of the pore size can be determined by a means to form the pores. For example, in a case where the porous structure is built by nanofibers, the pore size is substantially limited by a fiber size of the nanofibers, and in a case where the porous structure is built by hollow particles, the pore size is substantially limited by a hollow size of the hollow particles which is to be described later. Accordingly, the lower limit value of the pore size may be 1 nm.

Furthermore, in order to encumber fitting of a foreign substance other than the toner particles into the pores, the pore size is preferably 100 nm or less. The foreign substance herein is, for example, an external additive which has a large particle size exceeding 100 nm and easily falls off toner base particles. Still further, in order to suppress an influence (gloss reduction) on appearance of a toner image due to unevenness in a surface of the toner image fixed on the recording medium, the pore size is preferably 50 nm or less.

The porous structure in the surface layer, the pore size of the pores, and the mean particle size of the toner particles can be measured by known methods, and can be measured by a laser microscope, an electron microscope, and the like. Specifically, the porous structure can be determined by observing, with a scanning electron microscope (SEM), a torn surface of part of the surface layer or a torn surface of a sample in which part of the surface layer is embedded with an ultraviolet curing resin, or by observing a cut thin section with a transmission electron microscope (TEM). The pore size and the mean particle size are determined by measuring the size of randomly selected 20 pores or toner particles with a device that offers required magnification, for example, a laser microscope and SEM, and by calculating each arithmetic mean value as required. In a case where an opening of the pores or a particle shape of the toner particles on the image is not circle, a short diameter is measured as the pore size or as the particle size.

The porous structure can be built by a known method for forming a porous structure in a layer. For example, the porous structure can be achieved by a method for foaming foamable particles in a layer, a method for removing a soluble or sublimable component from a layer containing the component. The surface layer having the porous structure is preferably a matrix containing hollow particles or an aggregate of nanofibers from a viewpoint of achieving a desired pore size or desired porosity of the pores.

The surface layer including the hollow particles can be configured to include, for example, the hollow particles and a matrix that binds those hollow particles. A content of the hollow particles in the surface layer can be determined, for example, within a range that achieves the desired porosity of the surface layer. Besides the aforementioned measurement method of the porous structure, note that the porosity can be obtained by separately preparing a sample of the surface layer and by calculating the porosity based on a film thickness and mass per unit area of the sample.

The hollow particles are particles having independent or continuous hollow portions therein. The hollow particles form the pores by exposing the hollow particles themselves or fracture cross-sections thereof on the surface of the surface layer. The pores in this case may be hollow portions included in the hollow particles. Other than the hollow portions, the pores may be holes which are formed on the surface of the surface layer as the hollow particles fall from the matrix.

The hollow particles being too hard makes it difficult to expose the pores on the surface layer so that the hollow particles are preferably made of resin instead of an inorganic material. The resin herein requires resistance against a fixing temperature so that it is preferably a crosslinkable resin. Since typical toner particles includes an oily substance, the resin is preferably a crosslinkable fluororesin having a C—F structure with low attachment force with respect to toner particles including such an oily substance.

Examples of the resin include polyethylene, polypropylene, polystyrene, polyisobutylene, polyester, polyurethane, polyamide, polyimide, polyamideimide, alcohol soluble nylon, polycarbonate, polyarylate, phenol, polyoxymethylene, polyetheretherketone, polyphosphazene, polysulfone, polyether sulfide, polyphenylene oxide, polyphenylene ether, polyparabanic acid, polyallyl phenol, fluororesin, polyurea, ionomer, silicone, and mixtures or copolymers thereof.

An example of the crosslinkable fluororesin having the C—F structure includes a fluorine compound including a polymerizable functional group. An example of the fluorine compound include a compound having a structure in which a polymerizable functional group such as a (meth) acryloyl group (one or both of an acryloyl group and a methacryloyl group) and a hydrolyzable group such as an alkoxy group that binds to a silicon atom, and a compound having a fluorine-containing structure such as a perfluorocarbon structure and a perfluoropolyether structure are polymerized using a radical-generating agent, water, heat, light, and the like in accordance with the polymerizable functional group.

From a viewpoint that the holes may be the pores, the particle size of the hollow particles is preferably half or less of the particle size of the toner particles to be used: for example, less than 1 μm.

A diameter (hollow size) of the hollow portions of the hollow particles is preferably less than 1 μm, more preferably 100 nm or less, and still more preferably 50 nm or less, for the reason described in the case of the pores.

The International Union of Pure and Applied Chemistry (IUPAC) defines holes having a diameter of 2 to 50 nm as mesopores. From a viewpoint of achieving a preferable hollow size, the hollow particles are preferably mesoporous resin particles. The mesoporous resin particles are resin particles having a porous structure due to mesopores. A pore size of the mesopores in the mesoporous resin particles may be constant or may be variable within the above range of mesopores. The above hollow size and the mesopores can also be determined by a method similar to the aforementioned method in the case of the pores. There is no theoretical lower limit in the hollow size as similar to that of the pore size, and the lower limit can be appropriately determined from other viewpoints such as productivity.

As similar to the above hollow particles, the matrix herein also requires resistance against the fixing temperature so that it is preferably made of a crosslinkable resin. For a reason similar to the case of the resin included in the hollow particles, the resin included in the matrix is also preferably a crosslinkable fluororesin having a C—F structure.

Examples of the resin included in the matrix may be the same as the resin included in the hollow particles. The resin included in the hollow particles and the resin included in the matrix may be of similar kind or different kinds.

A content of the matrix in the surface layer can be determined in consideration of various properties required for the surface layer, and is preferably 30 to 90 volume percent from a viewpoint of, for example, heat conductivity and flexibility.

The surface layer containing the hollow particles can be produced by, for example, applying, to the elastic layer, a coating material which contains the hollow particles and a radical polymerizable monomer having a fluorine-containing organic group, and by radically polymerizing the monomer in the formed coating film, and by abrading a surface of the obtained cured film, if required, so that the pores (hollow portions) are exposed.

The surface layer including the nanofibers can be configured to include an aggregate of nanofibers. The nanofibers are fibers having a nano-order fiber size. The nanofibers may be artificial fibers obtained by a known method such as an electrospinning method, but from a viewpoint of cost and a viewpoint of facilitating an oil repellent treatment on a surface which is to be described, the nanofibers are preferably cellulose nanofibers.

The smaller the fiber size of the nanofibers, the more reliably a foreign substance, such as external additive particles falling off the toner base particles, is prevented from fitting into the pores formed on the surface layer so that the fiber size is preferably mainly 50 nm or less. The porosity of the surface layer including the nanofibers can be adjusted by the fiber size of the nanofibers or by combining other particles or fibers. For example, it is possible to increase the porosity of the surface layer including the nanofibers by mixing fine particles having the fiber size of the nanofibers and those having an appropriate particle size, or by mixing fibers with low ravelability (for example, a bulky fiber having a large fiber size and having branches in part).

In order to prevent the toner particles from fitting into the pores of the nanofibers included in the surface layer, and in order to reduce the attachment force of the recording medium with respect to the fixing member at the time of fixing, it is preferable that an oil repellent treatment is performed on the surface of the nanofibers. The oil repellent treatment is a treatment to degrade attachment properties with respect to the aforementioned oily component. This treatment can be carried out, for example, by modifying the surface of the nanofibers with a fluorine-containing organic group. In this manner, the oil repellent treatment can be performed by a known method for modifying a surface of a fiber with a functional group.

The surface layer including the nanofibers can be produced, for example, by applying a water dispersion of cellulose nanofibers to the surface of the elastic layer and drying the surface to form a layered aggregate of the cellulose nanofibers. Furthermore, the oil repellent treatment can be performed by applying a compound having a fluorine-containing organic group, for example, a fluorine-containing metal alkoxide such as silane alkoxide having a perfluoropolyether structure, to the surface of the cellulose nanofibers of the aggregate and by reacting an alkoxy group of the fluorine-containing metal alkoxide with a hydroxyl group on the surface.

A thickness of the surface layer can be appropriately determined based on a range in which desired properties are emerged. The thickness is preferably 5 to 40 μm, more preferably 10 to 35 μm, and still more preferably 15 to 30 μm from a viewpoint of, for example, heat transfer, readiness for deformation in the elastic layer, and emergence of demoldability.

The fixing member can be produced by a method including a process to prepare the surface layer on the elastic layer included in a laminated body of the base layer and the elastic layer. The base layer and the elastic layer (the laminated body) can be prepared by a known method by which these layers can be prepared. The surface layer can be produced, for example, by the method exemplified above.

The fixing member is applied to a fixing device in an electrophotographic image forming apparatus. The image forming apparatus including the fixing member can be configured as similar to a known image forming apparatus including a fixing device configured to fix an unfixed toner image on a recording medium onto the recording medium by heating and pressuring the toner image with a fixing member, except that the image forming apparatus herein includes the aforementioned fixing member. In the image forming apparatus, the fixing member is offered by a fixing process in a known electrophotographic image forming method.

As described above, the fixing member may be configured as a fixing sleeve or an endless fixing belt, but the endless fixing belt is preferable since such a configuration makes it easier to increase a sheet ejection angle at the time of fixing and is advantageous to the separability. The term "sheet ejection angle" indicates an angle (θ in FIG. 2) at a downstream end of the fixing nip portion in a conveyance direction of the recording medium, being formed by a tangent of the fixing belt (L2 in FIG. 2) relative to a straight line (L1 in FIG. 2) that is parallel to a straight line connecting axes of two rollers that form the fixing nip portion.

The fixing device can be configured as similar to a known fixing device having a structure in accordance with a configuration of a fixing member. For example, in a case where the fixing member is the above fixing belt, the fixing device preferably has a structure using the fixing belt, that is, a known structure that achieves, for example, fixing by a biaxially stretched belt, fixing by a pad pressing belt, and fixing by an IH belt.

In the fixing method and the image forming method using the fixing member, known toner and a known recording medium can be employed appropriately. The toner may be a one-component developer composed of toner particles, or may be a two-component developer composed of the toner particles and carrier particles. The toner particles include toner base particles and an external additive that attaches to a surface thereof. The toner base particles are, for example, resin particles containing a binder resin and a colorant, and the external additive includes inorganic oxide particles such as silica and tin oxide.

From a viewpoint of preventing the toner particles from fitting into the pores in the surface layer of the fixing member, it is preferable to use toner having a toner particle size two or more times as large as the pore size of the pores. The toner particle size may be a value representing the size of the toner base particles and may be a mean particle size of the toner base particles. The mean particle size herein may be a mean number diameter, or a mean volume diameter. Since the toner particle size is usually substantially even, it may also be the particle size of the toner particles.

As for the recording medium, a known recording medium used in the electrophotographic image forming method can be used. Examples of the recording medium include plain paper, coated paper such as photo paper, thick paper such as postcards and business cards, resin sheets such as OHP films, and resin films for packaging such as a polyethylene terephthalate (PET) film and a polypropylene (PP) film.

Hereinafter, the embodiment of the present invention will be described with reference to the drawings.

As illustrated in FIG. 1, an image forming apparatus 10 includes an image reading section 20, an image forming section 30, an intermediate transfer section 40, a fixing device 60, and a sheet conveyance section 80.

The image reading section 20 reads an image from a document D and obtains image data to form an electrostatic latent image. The image reading section 20 includes a sheet feeding device 21, a scanner 22, a CCD sensor 23, and an image processing unit 24.

The image forming section 30 includes, for example, four image forming units 31 corresponding to each of those colors: yellow, magenta, cyan, and black. Each of the image forming units 31 has the same structure except that each contains toner of different colors, and each of them includes a photosensitive drum 32, a charging device 33, an exposure device 34, a developing device 35, and a cleaning device 36.

The photosensitive drum 32 is an image carrier to carry an electrostatic latent image and a toner image corresponding thereto, an example of which is a negatively charged organic photoreceptor having photoconductivity. The charging device 33 is a device to charge the photosensitive drum 32, an example of which is a corona charging device configured to charge the photosensitive drum 32 without touching the drum. The charging device 33 may also be a contact-type charging device that brings a contact-type charging member such as a charging roller, a charging brush, and a charging blade into contact with the photosensitive drum 32 so as to charge the drum. The exposure device 34 is a device to irradiate the charged photosensitive drum 32 with light so as to form an electrostatic latent image, an example of which is a semiconductor laser.

The developing device 35 is a device to supply toner to the photosensitive drum 32 on which the electrostatic latent image is formed so as to form a toner image corresponding to the electrostatic latent image, including: for example, a developing container configured to contain toner; a developing roller disposed in an opening of the developing container; a stirring roller and a conveyance roller configured to move the toner inside the developing container toward the developing roller while stirring the same; and a developing blade configured to regulate a layer thickness of toner particles carried on the developing roller. The toner is, for example, the aforementioned two-component developer.

The toner particle size is, for example, the mean particle size of the toner base particles, and is about 6 to 7 μm (for example, 6.5 μm). The term "toner image" indicates a state where toner is aggregated into an image.

The cleaning device 36 is configured to remove transferred residual toner from the photosensitive drum 32, including: for example, an elastic blade (cleaning blade) configured to contact with the photosensitive drum 32; and a cleaning container configured to contain the transferred residual toner removed by the elastic blade.

The intermediate transfer section 40 includes a primary transfer unit 41 and a secondary transfer unit 42. The primary transfer unit 41 includes an intermediate transfer belt 43, a primary transfer roller 44, a backup roller 45, a plurality of first support rollers 46, and a cleaning device 47.

The intermediate transfer belt 43 is an endless belt. The intermediate transfer belt 43 is supported by the backup roller 45 and the first support rollers 46, being strained on an endless track.

The secondary transfer unit 42 includes a secondary transfer belt 48, a secondary transfer roller 49, and a plurality of second support rollers 50. The secondary transfer belt 48 is also an endless belt. As similar to the intermediate transfer belt 43, the secondary transfer belt 48 is supported by the secondary transfer roller 49 and the second support rollers 50, being strained on the endless track.

The cleaning device 47 is configured to remove residual toner from the intermediate transfer belt 43 after secondary transferring, including: for example, an elastic blade (cleaning blade) configured to contact with the intermediate transfer belt 43; and a cleaning container configured to contain the toner removed by the elastic blade.

Figure 2:
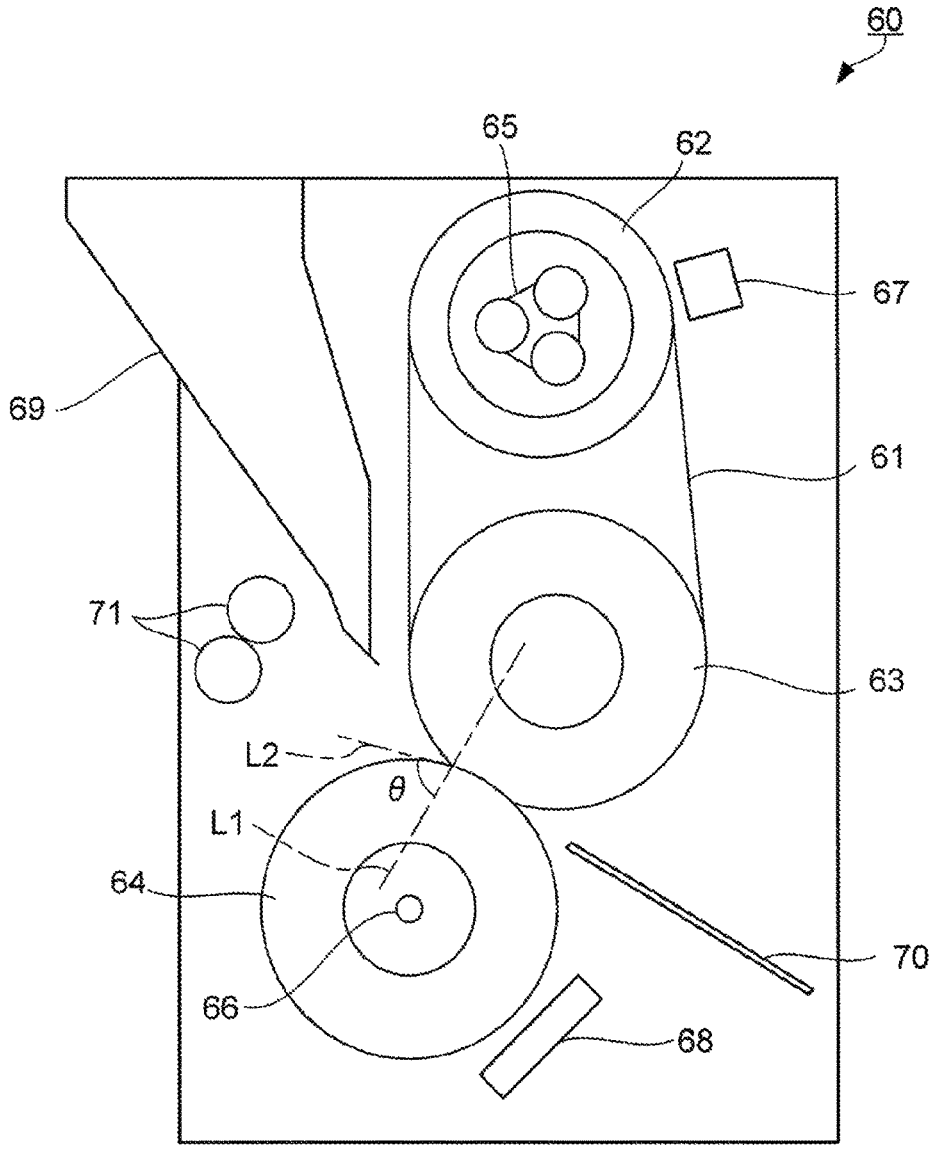
FIG. 2 is a schematic view illustrating a configuration of a fixing device according to the embodiment.

As illustrated in FIG. 2, the fixing device 60 includes: a fixing belt 61; a heating roller 62 and a first pressure roller 63 configured to support the fixing belt 61; a second pressure roller 64 opposing the first pressure roller 63 and capable of being disposed at a position pressing the first pressure roller 63 through the fixing belt 61; a first temperature sensor 67 configured to detect a surface temperature of the fixing belt 61; a second temperature sensor 68 configured to detect a surface temperature of the second pressure roller 64; an air blowing-and-separating device 69 configured to blow air from a side close to the fixing belt 61 toward the downstream end of the fixing nip portion in the conveyance direction of a sheet S so as to aid separation of the sheet S from the fixing belt 61; and a guide plate 70 and a guide roller 71 configured to guide the sheet S to the fixing nip portion before and after fixing or guide the sheet S in the conveyance direction after fixing. The sheet S corresponds to the recording medium.

Figure 3A:
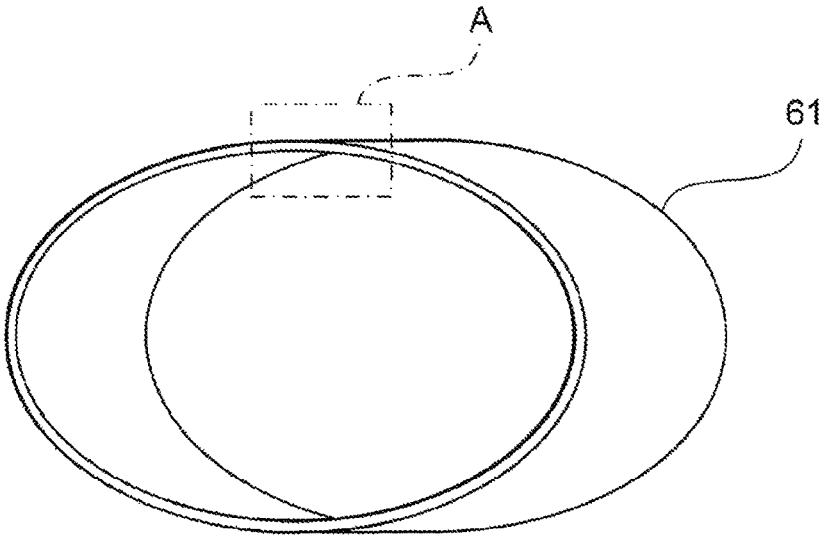
FIG. 3A is a schematic view illustrating an example of a fixing belt according to the embodiment.
Figure 3B:
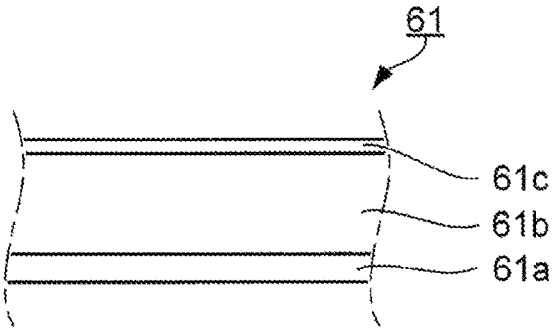
FIG. 3B is a schematic view illustrating an area A illustrated in FIG. 3A in an enlarged manner.

As illustrated in FIGS. 3A and 3B, the fixing belt 61 is an endless belt formed by laminating a base layer 61*a*, an elastic layer 61*b*, and a surface layer 61*c* in the order mentioned. The base layer 61*a*, elastic layer 61*b*, and surface layer 61*c* correspond to the aforementioned base layer, elastic layer, and surface layer. Furthermore, the fixing belt 61 corresponds to the aforementioned fixing member.

The heating roller 62 includes a rotatable aluminum sleeve and a heater 65 disposed inside the sleeve. The first pressure roller 63 includes, for example, a rotatable cored bar and an elastic layer disposed on an outer periphery of the cored bar. The second pressure roller 64 includes, for example, a rotatable aluminum sleeve and a heater 66 disposed inside the sleeve. The second pressure roller 64 is disposed so that it can freely approach or separate from the first pressure roller 63. Each of the heaters 65 and 66 is, for example, a halogen lamp, a resistance heating element, and a heating device of an induction heating (IH) type.

As illustrated in FIG. 1, the sheet conveyance section 80 includes three sheet feeder tray units 81, a plurality of registration roller pairs 82, and an exit roller 83. Those sheets (for example, plain paper) S that are identified based on basis weights, sizes, and the like are contained in the sheet feeder tray units 81 for each preset type. The registration roller pairs 82 are disposed so as to form a desired conveyance route. The exit roller 83 is disposed at a position where the sheet S ejected from the fixing device 60 is conveyed outside the device.

Hereinafter, image formation performed by the image forming apparatus 10 will be described.

In the image reading section 20, the sheet feeding device 21 sends a document D placed on a document tray to the scanner 22. The scanner 22 optically scans the document D to form an image on a light receiving surface of the CCD sensor 23 with reflected light from the document D, and reads the image of the document D. The image processing unit 24 performs predetermined image processing on image data obtained herein, as required.

In the image forming section 30, the photosensitive drum 32 rotates at a constant peripheral velocity. The charging device 33 uniformly charges a surface of the photosensitive drum 32 so that the drum has a negative charge. The exposure device 34 irradiates the photosensitive drum 32 with a laser beam corresponding to an image of each color component so as to form an electrostatic latent image of each color component on the surface of the photosensitive drum 32. The developing device 35 attaches toner of each color component to the surface of the photosensitive drum 32 so as to visualize the electrostatic latent image and form a toner image.

The intermediate transfer belt 43 runs at a constant speed in a clockwise direction with respect to a plane of paper of FIG. 1 due to, for example, rotary drive of the first support rollers 46. As the intermediate transfer belt 43 is pressed against the photosensitive drum 32 by the primary transfer roller 44, a primary transfer nip portion is formed, and the toner image of each color on the photosensitive drum 32 is primarily transferred onto the intermediate transfer belt 43 so that the toner image of each color is superimposed. After the primary transfer, transferred residual toner remaining on the surface of the photosensitive drum 32 is removed from the surface by the elastic blade in the cleaning device 36.

On the other hand, as the secondary transfer roller 49 is pressed against the backup roller 45 through the intermediate transfer belt 43, a secondary transfer nip portion is formed. The sheet S fed from one of the sheet feeder tray units 81 is conveyed to the secondary transfer nip portion. An inclination and a position in a width direction (leaning) of the sheet S are corrected while the sheet S is conveyed by the registration roller pairs 82.

When the sheet S passes through the secondary transfer nip portion, the toner image carried on the intermediate transfer belt 43 is secondarily transferred onto the sheet S. The sheet S carrying the transferred toner image is conveyed toward the fixing device 60. After the secondary transfer, transferred residual toner remaining on a surface of the intermediate transfer belt 43 is removed from the surface by the elastic blade in the cleaning device 47.

The fixing device 60 heats and pressurizes the conveyed sheet S at a fixing nip portion so as to fix the toner image on the sheet S. The fixing belt 61 moves along the endless track, for example, by rotary drive of the first pressure roller 63, being heated to a desired temperature (for example, 170° C.) by the heater 65 of the heating roller 62. The temperature of the fixing belt 61 is maintained within a range of desired temperature by feedback control based on a detected value of the temperature offered by the first temperature sensor 67. Similarly, the second pressure roller 64 also rotates so that the heater 66 heats the fixing belt 61 and keeps the temperature within the range of desired temperature based on a detection value offered by the second temperature sensor 68.

The second pressure roller 64 approaches the first pressure roller 63 in accordance with the conveyance of the sheet S, and presses the elastic layer of the first pressure roller 63 through the fixing belt 61 so as to form a contact portion (fixing nip portion) between the fixing belt 61. The sheet S is thermally pressurized as passing through the fixing nip portion. Accordingly, toner particles included in the toner image are fused and attached to the sheet S. In this manner, the sheet S is formed with a fixed image in which the toner image is fixed.

The air blowing-and-separating device 69 blows air to a leading end of the sheet S conveyed from the fixing nip portion. The sheet S is then guided in a direction apart from the fixing belt 61 and separates therefrom, being guided outside the fixing device 60 by the guide roller 71 and guided outside the image forming apparatus 10 by the exit roller 83. In this manner, the toner image fixed in the image forming apparatus 10 is formed.

In electrophotographic image formation, the fixing belt 61 emerges excellent separability for a long period with respect to the sheet S at the time of fixing. The possible reason will be described hereinafter.

In a typical fixing process in the electrophotographic image forming method, attachment force is usually generated between a surface of a heated fixing member and a surface of toner particles heated and fixed on a recording medium (medium) by the fixing member. This attachment force encumbers separation between the fixing member and the medium. The attachment force is proportional to a contact area.

However, the surface layer of the fixing member (fixing belt 61) of this embodiment has the porous structure as described above. The pore size of the pores in this porous structure is less than 1 μm. In this manner, the surface of the fixing member has the porous structure due to the pores that are sufficiently small relative to the toner particle size.

Therefore, the contact area decreases by the number of pores exposed on the surface of the surface layer, which decreases the attachment force. Although the surface layer is abraded with the use of the fixing member, the surface layer has the porous structure so that abrasion continuously generates new pores. Thus, the aforementioned effect to improve the separability is maintained for a long period.

Furthermore, the pore size of the pores is half or less of the particle size of the toner particles. Therefore, unfixed toner particles are prevented from fitting into the pores so that the aforementioned effect to reduce the attachment force is also maintained for a long period.

Still further, in a case where the surface layer includes a fluorine-containing organic component, a toner component fused at the time of fixing is prevented from attaching to the surface layer. Therefore, such a configuration is preferable from a viewpoint of the attachment force reducing effect.

As described above, in the aforementioned embodiment, the fixing member can singly enhance the separability with respect to the recording medium so that the aforementioned embodiment is capable of improving image formation under conditions with poor separability. For example, according to the aforementioned embodiment, it is possible to employ media without stiffness (media with high flexibility and low rigidity), or it is possible to further speed up the processes in the image formation.

Furthermore, according to the aforementioned embodiment, it is possible to remove a separation-aid device such as the air blowing-and-separating device. In this case, the structure of the fixing device can be simplified and downsized, and an amount of heat drawn from the fixing member is reduced due to the stream of air from the air blowing-and-separating device, which leads to power saving in the fixing device. In the aforementioned embodiment, it is possible to achieve one or a combination of these advantages.

As is clear from the above description, the fixing member of this embodiment includes the base material, elastic layer, and surface layer, all of which are laminated in the order in a thickness direction, and the surface layer has the porous structure formed by the plurality of pores, each of which has the pore size of less than 1 μm.

The image forming apparatus according to this embodiment includes a fixing device that thermally pressurizes an unfixed toner image through a fixing member so as to fix the toner image on a recording medium that carries the toner image. Furthermore, the fixing method according to this embodiment in an electrophotographic image forming method includes thermal pressurization of an unfixed electrophotographic toner image through a fixing member so as to fix the toner image on a recording medium that carries the toner image. Still further, the image forming method according to this embodiment includes a process to thermally pressurize an unfixed electrophotographic toner image through a fixing member so as to fix the toner image on a recording medium that carries the toner image.

Therefore, according to this embodiment, it is possible to emerge high separability over a long period even with respect to media without stiffness such as tissue paper when fixing a toner image in electrophotographic image formation.

Furthermore, the fact that the surface layer contains the hollow particles is more efficient in easily controlling the porosity of the surface layer and the pore size of the pores, and the fact that the hollow particles are mesoporous resin particles is more efficient in reducing the attachment force of the recording medium with respect to the fixing member at the time of fixing.

Still further, the fact that the surface layer contains nanofibers is more efficient in increasing the porosity of the surface layer, and the fact that the nanofibers is cellulose nanofibers is more efficient in enhancing productivity and in reducing the attachment force.

Still further, the fixing member being configured as the endless belt is more efficient from a viewpoint of enhancing the separability.

EXAMPLES

The present invention will be described in more detail with reference to the following Examples and Comparative Example. Each operation was performed at room temperature (20° C.) unless otherwise specified hereinafter. It should be noted that the present invention is not limited to the following Examples.

[Preparation of Hollow Particle A]

The following components were contained in a container in the following amounts, and 0.75 parts by mass of an oil-soluble polymerization initiator "V-65" (produced by Wako Pure Chemical Industries, Ltd.) was added to the container and dissolved. The following "Fomblin MT70", a product of Solvay S.A., is a 2-butanone solution of tetramethacrylate having a perfluoropolyether structure. "FOMBLIN" is a registered trademark of the company.

| | |
|---|---|
| styrene | 37 parts by mass |
| divinylbenzene | 48 parts by mass |
| Fomblin MT70 | 15 parts by mass |
| 2-butanone | 150 parts by mass |

To the obtained solution, 720 parts by mass of an aqueous solution containing 0.12% by mass of sodium lauryl sulfate, and 1.03 parts by mass of a water-soluble polymerization initiator "VA-57" (produced by Wako Pure Chemical Industries, Ltd.) were added. The mixture was dispersed with a dispersion/emulsification machine "CLEARMIX" (manufactured by M Technique Co., Ltd., "CLEARMIX "is a registered trademark of the company) at 10,000 rpm for 6 minutes so as to prepare an emulsion dispersion.

The emulsion dispersion was put into a separable flask equipped with a stirrer, a water-cooling reflux tube, and a nitrogen inlet tube. Nitrogen stream was introduced into the emulsion dispersion while the emulsion dispersion was stirred, and then heated. The emulsion dispersion was thermally stirred for 8 hours while the polymerization temperature was kept at 60° C., thereby causing a polymerization reaction to form hollow particles.

Then, the produced hollow particles were collected by suction filtration. After being washed with ion exchanged water, the hollow particles were spread over a tray and dried at 40° C., thereby obtaining white hollow particles A at a yield of 96%.

A volume-basis median diameter of the hollow particles A was measured with a laser diffraction particle size analyzer "LA-750" (manufactured by Horiba, Ltd.) and was determined to be 0.81 μm.

A segment having a thickness of 50 nm and containing the hollow particles A was prepared. Observing the segment with a TEM, it was determined that the inside of the hollow particles A was porous and that a pore size of each pore in the porous structure was 15 nm. Considering that black portions in an image captured by the TEM were pores, 20 pores were randomly extracted from the image. The pore size herein represents a mean value of short diameter of those 20 pores.

A hollow ratio of the hollow particles A was measured, being determined to be 51 volume percent. A method for measuring the hollow ratio will be hereinafter described.

Added were 10.0 g of the hollow particles A to a mixture of 2.4 g (in terms of solid content) of an aqueous urethane emulsion "WBR-016 U" (produced by Taisei Fine Chemical Co., Ltd.) and 2.0 g of pure water. The mixture was dispersed with a planetary centrifugal mixer "ARE 310" (manufactured by Thinky Corporation), thereby obtaining a dispersion. This dispersion was filled in a mold having a width of 80 mm, a length of 120 mm, and a thickness of 2 mm. After being dried at room temperature, the dispersion was thermally dried and solidified, and then taken out from the mold, thereby preparing a sample plate. The volume and mass of the sample plate were measured with a specific gravity meter "DME-220H" (manufactured by Shinko Electrics Industries Co., Ltd.) so as to calculate the hollow ratio Hr of the hollow particles A in accordance with the following formula (1).

$$\text{Hr (volume percent)} = V1/V2 \times 100 \quad (1)$$

In the formula (1), V1 represents volume of an internal space of the hollow particles A, that is, volume of voids in the sample plate. Furthermore, V2 represents total volume of the hollow particles A, that is, a sum of the volume of voids in the sample plate and volume of resin portions included in the hollow particles A.

The "volume of voids (or V1) in the sample plate" can be obtained from the following formula (2).

$$V1 = VSB - VBR + VPR + VW \quad (2)$$

In the formula (2), VSB represents volume of the sample plate, VBR represents volume of binder resin (polyurethane) portions in the sample plate, VPR represents volume of the resin portions included in the hollow particles A, and VW represents volume of water entering the voids between the particles.

The volume VBR of the binder resin portions can be obtained from the following formula (3), and the volume VPR of the resin portions included in the hollow particles A can be obtained from the following formula (4).

$$VBR = WBR/DBR \quad (3)$$

$$VPR = WHP/DPR \quad (4)$$

In the formula (3), WBR represents mass of the binder resin portions in the sample plate, and DBR represents density of the binder resin portions, which is 1.07 in the above case. In the formula (4), WHP represents mass of the hollow particles in the sample plate, and DPR represents density of the resin portions included in the hollow particles A, which is assumed to be 1.05 in the above case.

The mass WBR of the binder resin portions in the sample plate can be obtained from the following formula (5). In the formula (5), WSB represents mass of the sample plate, and a coefficient "0.1935" is a mass ratio ({2.4/(10.0+2.4)}) of the hollow particles A to the solid content in the dispersion. The mass WHP of the hollow particles in the sample plate can be obtained from the following formula (6). In the formula (6), WSB represents the mass of the sample plate. A coefficient "0.8065" is a ratio of portions other than the solid content in the dispersion (that is, a ratio of the voids (1−0.1935)).

$$WBR = WSB \times 0.1935 \quad (5)$$

$$WHP = WSB \times 0.8065 \quad (6)$$

Example 1

A cylindrical stainless cored bar having an outer diameter of 99 mm was adhered to the inside of a belt base material including a thermosetting polyimide resin having an inner diameter of 99 mm, a length of 360 mm, and a thickness of 70 μm. Next, the belt base material was covered by a cylindrical die from the outside thereof so as to hold the cored bar and the cylindrical die in a coaxial manner and to form a cavity between the cored bar and the cylindrical die. Next, a material of silicone rubber A was injected into the cavity, being thermally cured to prepare an elastic layer of the silicone rubber A having a thickness of 200 μm. The material of the silicone rubber A is a composition obtained by mixing 100 parts by mass of dimethylpolysiloxane having a side-chain vinyl group and 15 parts by mass of silica.

Next, an endless laminated body of the base material and the elastic layer prepared as described above was stretched by a spiral coating apparatus, being rotated and subjected to a corona treatment.

On the other hand, a coating material 1 was prepared for a surface layer. The coating material 1 was prepared by the following procedures: a mixture of 10 parts by mass of hollow particles A, 40 parts by mass of "Fluorolink MD 700", and 300 parts by mass of 2-butanone was dispersed with an ultrasonic homogenizer, and 2 parts by mass of IRGACURE 184 (produced by BASF Japan Ltd.) as a polymerization initiator was added to the mixture and dissolved.

"Fluorolink MD 700", a product of Solvay S.A., is dimethacrylate having a perfluoropolyether structure. "FLUOROLINK" is a registered trademark of the company. As for "IRGACURE", it is a registered trademark of BASF Japan Ltd.

The coating material 1 was applied to an outer periphery of the endless laminated body by a spiral coating method, thereby forming a coating film of the coating material 1. After the coating film was thermally dried at 60° C. for 10 minutes, the coating film was cured by radically polymerizing the dimethacrylate in the coating film with a mercury lamp configured to emanate ultraviolet with intensity of 1 kw/cm$^2$ at integrated light intensity of 600 mJ/cm$^2$, thereby preparing a surface layer having a film thickness of 15 μm.

The endless three-layer belt obtained in this manner was re-stretched by the spiral coating apparatus and rotated. Next, a wrapping film sheet No. 600, and then a wrapping film sheet No. 4000 (produced by 3M Co.) were pressed against a surface of the surface layer of the three-layer belt so that each wrapping film sheet was rotated for about 10 times under a load of 40 gf/cm$^2$ (0.39N/cm$^2$), and the uppermost surface of the surface layer was polished. Accordingly, using a laser microscope, a cross section of the hollow particles contained in the surface layer was determined to appear on the surface of the surface layer. In this manner, a fixing belt 1 was prepared with the base material, elastic layer, and surface layer being laminated in the order mentioned.

Based on SEM images of the surface and the cross section of the fixing belt 1, porosity of the surface layer of the fixing belt 1 and a pore size of a porous structure of the surface layer were obtained. Herein, the porosity was determined to be 21%, and the pore size was determined to be 15 nm.

Example 2

A coating material 2 was prepared for a surface layer. The coating material 2 was prepared by diluting 2% by mass of an aqueous dispersion of cellulose nanofibers having a fiber width less than 10 nm, "RHEOCRYSTA I-2SP" (produced by DKS Co. Ltd., "RHEOCRYSTA" is a registered trademark of the company), to one having cellulose nanofiber concentration of 0.35% by mass.

The coating material 2 for the surface layer was applied by the spiral coating method to the outer periphery of the aforementioned endless laminated body on which the corona treatment was performed, thereby forming a coating film of the coating material 2. Next, the coating film was thermally dried at 60° C. for 20 minutes, and then at 100° C. for 60 minutes to form a nanofiber accumulated layer having a film thickness of 15 μm on the outer periphery.

A three-layer belt of the base layer, elastic layer, and nanofiber accumulated layer obtained in this manner was subjected to dip coating, using a fluorine-containing silane coupling agent solution. The fluorine-containing silane coupling agent solution is a solution in which "Fluorolink S10" (produced by Solvay S.A.) is diluted 50-fold by 2-butanone, and "Fluorolink S10" is perfluoropolyether including an ethoxysilane terminal group. Next, the nanofiber accumulated layer was thermally dried at 20° C. for 60 minutes, and then at 120° C. for 60 minutes to perform the oil repellent treatment on the nanofiber accumulated layer. Accordingly, a fixing belt 2 was prepared with the base material, the elastic layer, and the nanofiber accumulated layer on which the oil repellent treatment was performed being laminated in the order mentioned. It was determined that the surface layer of the fixing belt 2 has porosity of 55%, and a pore size of 8 nm.

Comparative Example 1

The aforementioned cored bar was adhered to the inside of the aforementioned belt base material, and the outside of the belt base material was covered by a cylindrical die holding a PFA tube having a thickness of 30 μm on its inner periphery so that the cored bar and the cylindrical die were held in a coaxial manner and that a cavity was formed therebetween. The material of the silicone rubber A was injected into the cavity, being thermally cured so as to prepare an elastic layer of the silicone rubber A having a thickness of 200 μm. In this manner, a fixing belt 3 was prepared with the base material, elastic layer, and PFA layer being laminated in the order mentioned.

[Evaluation]

Each of the fixing belts 1 to 3 was mounted on a full color copying machine "bizhub PRESS C 1070" (manufactured by Konica Minolta Inc., "bizhub" is a registered trademark of the company). As a recording medium, "npi high-quality paper 64 g/m$^2$" was used. A surface temperature of each fixing belt was set to 180° C. As for toner, used was a two-component developer including toner base particles having a mean volume diameter of 6.5 μm.

First, prepared was an unfixed whole solid image (an amount of attachment: 8.0 g/m$^2$) having a margin optionally selected per 1 mm at an edge of a sheet, and other than the margin, having an area prepared by two layers consisting of cyan and magenta (red).

Before and after an endurance test in which ten thousand A4 prints with black letters corresponding to a printing rate of 5% being arranged substantially evenly were prepared, a recording medium of the whole solid image was sent in a longitudinal direction of the sheet at speed of 60 sheets/min so as to make a surface including the solid image of the recording medium face the fixing belt. In regard to the recording medium with the whole solid image, a property of separability with respect to the fixing belt in the fixing device was evaluated by the following criteria.

○: The fixing belt and the recording medium with the whole solid image were separated when the margin in the edge was 0 mm or more and less than 4 mm.

×: The fixing belt and the recording medium with the whole solid image were separated when the margin in the edge was 4 mm or more.

Evaluation results are shown in Table 1.

TABLE 1

| | FIXING BELT NO. | SEPARABILITY | |
|---|---|---|---|
| | | BEFORE ENDURANCE TEST | AFTER ENDURANCE TEST |
| EXAMPLE 1 | 1 | ○ | ○ |
| EXAMPLE 2 | 2 | ○ | ○ |
| COMPARATIVE EXAMPLE 1 | 3 | x | x |

As is clear from Table 1, both of the fixing belts 1 and 2 having the porous surface layer show good separability before and after the endurance test. The possible reason is that the surface layer of each of the fixing belts 1 and 2 has the porous structure due to fine pores, which brings about a small contact area between a toner image, compared to the non-porous fixing belt (fixing belt 3), so that, in a fixing nip portion at the time of fixing, repulsive force due to rigidity of the recording medium excels attachment force of the recording medium with respect to the fixing belt. Another possible reason is that the pores are sufficiently small so that unfixed toner particles do not enter the pores during the endurance test and that the contact area are still sufficiently small even after the endurance test.

On the other hand, it is found that the fixing belt 3 requires a long margin in a front portion of a sheet in a sheet-sending direction, compared to the fixing belts 1 and 2. The possible reason is that a surface of the fixing belt 3 is adhered to a toner image so that, in a fixing nip portion at the time of fixing, the attachment force of the recording medium with respect to the fixing belt excels the repulsive force due to the rigidity of the recording medium, and accordingly, in order to separate the recording medium from the fixing belt 3, it requires a certain degree of free end (a part not being adhered to the toner image) in the front portion in the sheet-sending direction.

According to the present invention, in an electrophotographic image formation, a fixing member can singly enhance separability between a fixing member and a recording medium over a long period at the time of fixing. Therefore, according to the present invention, higher speed, higher performance, power saving, and diversification of a recording medium can be expected in an electrophotographic image forming apparatus, which leads to further dissemination of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing member comprising a base material, an elastic layer, and a surface layer, all of which are laminated in the order in a thickness direction, wherein the surface layer has a porous structure formed by a plurality of pores, each of which has a pore size of less than 1 μm.

2. The fixing member according to claim 1, wherein the surface layer includes a hollow particle.

3. The fixing member according to claim 2, wherein the hollow particle is a mesoporous resin particle.

4. The fixing member according to claim 1, wherein the surface layer includes a nanofiber.

5. The fixing member according to claim 4, wherein the nanofiber is a cellulose nanofiber.

6. The fixing member according to claim 1, wherein the fixing member has an endless belt shape.

7. An image forming apparatus of an electrophotographic type, the apparatus comprising a fixing device that thermally pressurizes an unfixed toner image through a fixing member so as to fix the toner image on a recording medium that carries the toner image, wherein the fixing member is the fixing member according to claim 1.

8. A fixing method in an electrophotographic image forming method, the fixing method comprising thermally pressurizing an unfixed electrophotographic toner image through a fixing member so as to fix the toner image on a recording medium that carries the toner image, wherein the fixing member is the fixing member according to claim 1.

9. An image forming method comprising thermally pressurizing an unfixed electrophotographic toner image through a fixing member so as to fix the toner image on a recording medium that carries the toner image, wherein the fixing member is the fixing member according to claim 1.

* * * * *